United States Patent [19]

Müller et al.

[11] 4,365,465

[45] Dec. 28, 1982

[54] STOP MOTION FOR SPINNING MACHINE

[76] Inventors: Heinz Müller, Harzerweg 15, D-7321 Sparwiesen; Max Hartmannsgruber, Bleicherwiesen 8, D-7312 Kirchheim; Hermann Güttler, Porschestrasse 5, D-7333 Uhingen, all of Fed. Rep. of Germany

[21] Appl. No.: 214,836

[22] Filed: Dec. 10, 1980

[30] Foreign Application Priority Data

Dec. 28, 1979 [DE] Fed. Rep. of Germany ..... 2952533

[51] Int. Cl.[3] ..... D01H 13/18

[52] U.S. Cl. ..... 57/84; 57/87

[58] Field of Search ..... 57/80, 83–87

[56] References Cited

U.S. PATENT DOCUMENTS

| | | | |
|---|---|---|---|
| 1,064,280 | 6/1913 | Beede | 57/84 |
| 1,815,743 | 7/1931 | Stutz-Benz | 57/84 |
| 2,421,555 | 6/1947 | Fraser | 57/84 |
| 3,260,043 | 7/1966 | Anselmetti | 57/84 |

FOREIGN PATENT DOCUMENTS

| | | | |
|---|---|---|---|
| 555522 | 7/1932 | Fed. Rep. of Germany | 57/84 |
| 425612 | 3/1935 | United Kingdom | 57/84 |
| 651675 | 4/1951 | United Kingdom | 57/84 |
| 1333101 | 10/1973 | United Kingdom | 57/84 |

*Primary Examiner*—John Petrakes

*Attorney, Agent, or Firm*—Blanchard, Flynn, Thiel, Boutell & Tanis

[57] ABSTRACT

A roving moving to a spinning machine passes between top and bottom input rolls of which the top roll is adapted, upon breakage of the roving, to be raised by a lift member which is movable into engagement with the spindle of the top roll and carries with it a clamping element which serves to clamp the incoming broken end of the roving against the top roll to retain it ready for subsequent rethreading into the nip of subsequent drafting rollers.

20 Claims, 11 Drawing Figures

STOP MOTION FOR SPINNING MACHINE

BACKGROUND OF THE INVENTION

This invention relates to a spinning machine having a drafting frame with an input roll pair comprising a bottom input roll and a top input roll which can be lifted from the bottom roll in the event of yarn breakage and having an axle with which engagement means can be engaged.

DISCUSSION OF THE PRIOR ART

Is already known to provide an arrangement in which the top input roll is lifted off in the event of yarn breakage, for which purpose engagement elements act on axle journals of the top input roll.

These engagement elements are connected, by way of a complicated lever system, to a thread sensor. As soon as thread breakage occurs, roving supply is interrupted. What is disadvantageous in this known device is the complicated construction of the lifting-off device and the mechanical sensing of the thread, which controls the lifting-off of the input top roll.

It is furthermore known to provide a spinning machine having a device, associated with its drafting frame, for sensing roving breakage. In this arrangement, a lever element embraces the periphery of the bottom input roll and is provided with a locking device. In the event of thread breakage, the locking device is released and the entire device swings about the periphery of the bottom roll, as a result of which the lever element lifts the top roll from the bottom roll. Disadvantageous in this known proposal is the fact that no exactly-defined frictional force can be established between the movement of the bottom input roll and the component embracing said bottom roll. Furthermore, this known device is also complicated in construction.

It is, moreover, known, in spinning machines, to interrupt the supply of roving in the event of a thread breakage, by the roving being clamped fast by way of spring-loaded clamping elements. In this arrangement, however, the two rolls remain in their original position, and no lifting off of the input top roll occurs. The entire arrangement is of such a nature that control is achieved by way of an element which scans the thread, and hinged lever or toggle joint system. This arrangement, too, involves high expenditure on mechanical components, by reason of its construction.

Furthermore, it is known to provide a spinning machine having a drafting frame including a thread-breakage stopping device in which the top input roll is rolled, at its axle journal, from its position on the bottom roll onto a stationary support, the roving thereby being clamped fast. In this arrangement, the top roll and the bottom roll are connected to one another by way of a hinged lever system, but this again involves considerable constructional expenditure.

On twisting machines it is, moreover, already known to guide the axle journals of a top roll by means of a connecting link (or slotted) guide onto a support and, in so doing, to lift the top roll from the bottom roll. In this case, use is made of a locating wire which engages into a lever, provided with retention wires, and which thus achieves locking of the broken thread. In the event of thread breakage, a thread sensor causes lifting-off of the top roll. This known system is similarly complicated in construction.

The task of the present invention is to provide a machine of the kind mentioned at the introduction hereof, which ensures simple and reliable separation of the top input roll and bottom input roll as well as clamping of the leading end of the broken roving in such a manner as to permit rapid and automatic reinsertion into the nip of a following pair of rolls.

BRIEF OUTLINE OF THE INVENTION

In accordance with the invention, this problem is solved in that the engagement means comprises a movable lift element engaging under the axle of the top input roll and is provided with an actuating part and a clamping element which, upon yarn breakage, cooperates with the leading end of the roving and clamps it against roll surface of the top input roll. With this arrangement, one obtains the advantage that, as a result of the lift element engaging under the axle, rapid lifting of the top input roll from the bottom input roll is achieved in a very simple way, whilst the clamping element ensures satisfactory clamping of the roving. The entire device is simple in construction and may comprise merely of a single swivel lever, which is able to perform the two functions.

In a development of the invention, the lifting element may include a cam edge or be designed as a lifting wedge.

Furthermore, the possibility exists of the lifting element comprising a circular segment and being arranged on a swivel lever or rocking lever having a pivot axis which lies underneath the bottom input roll. In this way a constructionally simple design of the swivel lever can be achieved.

In accordance with a further development of the invention, the clamping element is designed as a clamping pin and may be arranged at the exit side of the input roll pair and may co-operate, below a horizontal plane which contains the axis of the top input roll, with the roll surface of the top input roll. With this arrangement, upon yarn breakage the roving is forced firmly against the roll surface of the raised top input roll with the result that a very reliable clamping of the yarn is obtained.

In further development of the invention, a guide table may be arranged between the input roll pair and a following roll pair. This guide table serves to guide the roving and prevents it from sagging downwards and missing entry into the nips of the centre rolls of the drawing frame upon resumption of operation. In the case of close roll setting, this guide table can be omitted. Then, when the swivel lever is hinged down, the clamping pin acts as support and guide for the roving. In the case of this construction, too, sagging of the roving so as to miss running into the nip of the next adjacent rolls is eliminated.

In accordance with a further preferred feature of the invention, the spinning machine has twin input top rolls and associated with each individual top roll is a lifting element which engages under the axle between the individual top rolls, either from the entry side or from the exit side of the input roll pair.

In another development of the invention, the possibility also exists of the lifting element engaging below the axle journals externally either from the exit side or from the entry side of the input roll pair. This provides for very wide possibilities in the use of the swivel lever in the machine of the invention, depending on prevailing constructional or design circumstances.

The actuating part may be movable either by hand and/or by means of a monitoring apparatus. Furthermore, the possibility exists of the actuating part being movable in response to a thread breakage signal. In this arrangement, the actuating part may be movable by a force store which is triggered or released by a thread breakage signal.

In the case of a spinning machine having a twin input top roll, in further development of the invention the possibility exists of the roll surfaces of the individual top input rolls being mounted so as to swing or oscillate on their axes. This arrangement provides a very good supporting effect.

Furthermore, it is conceivable, in accordance with another preferred feature of the invention, for the lifting element to have a notch or recess into which the axle or the axle journal locates in the lifting-off state of the top input roll so that positive arresting of the input top roll is achieved.

In accordance with yet a further development of the invention, in which the spinning machine has a twin input top roll, the elastic roll covering of each individual top roll may be bevelled conically at its end remote from the other individual top input roll, over about one quarter to one eighth of the width of the roll covering.

BRIEF DESCRIPTION OF THE DRAWINGS

The invention will be described further, by way of example, with reference to various exemplified embodiments, which are illustrated in the accompanying drawings. In these drawings.

DESCRIPTION OF THE ILLUSTRATED PREFERRED EMBODIMENT

Figure 1:
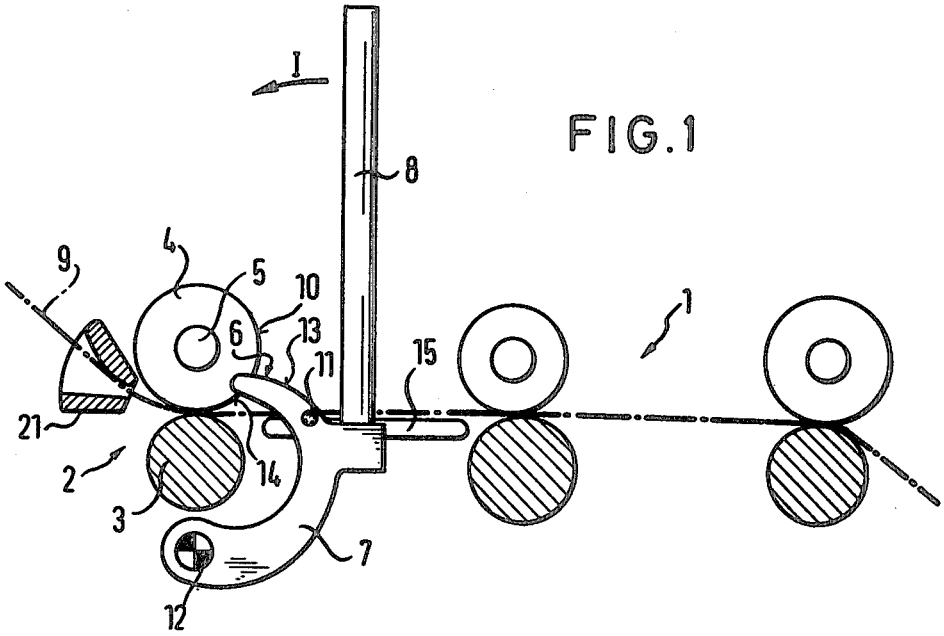
FIG. 1 is a diagrammatic side view illustrating a drawing frame of a preferred spinning machine of the invention, showing its bottom input roll and top input roll in the working positions.

Referring firstly to FIG. 1, in the case of a schematically-shown drafting frame 1 of a spinning machine an input roll pair 2 comprises a bottom input roll 3 and a top input roll 4. Mounted underneath the bottom input roll 3, on a pivot 12, is a swivel lever 7 which has an actuating part 8.

This swivel lever 7 has a lifting element 6 providing a cam track which is eccentric relative to the pivot 12 and which is advantageously in the configuration of a circular segment 13. On its inside (the side opposite to that from which it is viewed in the drawings) the swivel lever 7 is provided with a clamping element 11 which is designed, for example, as a clamping pin.

Between the input roll pair 2 and following rollers of the drafting frame 1 there is a guide table 15 which is so disposed that roving 9 is given an exactly defined direction of movement as a result of the successive action of guide 21, the input roll pair 2, the guide table 15 and the following rolls of the drafting frame 1.

Figure 2:
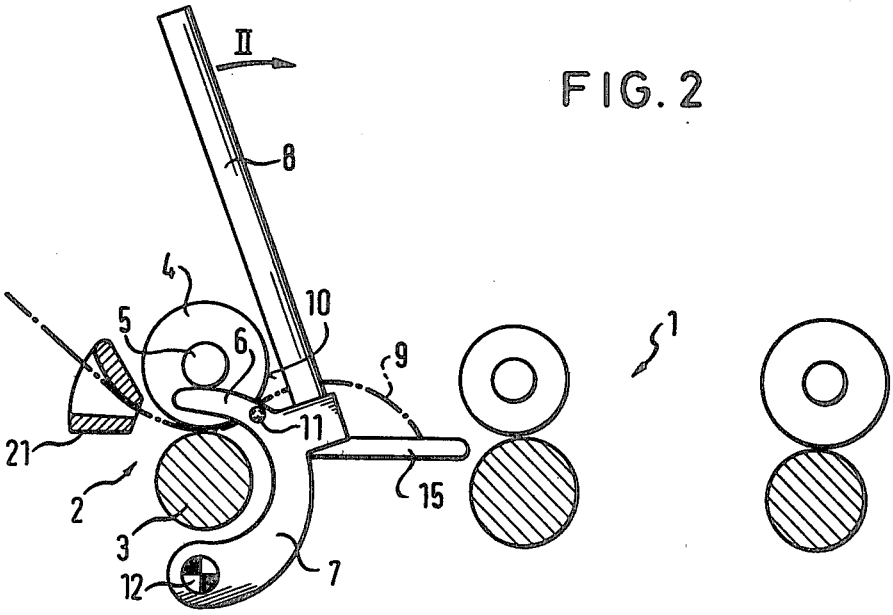
FIG. 2 is a view similar to FIG. 1 but with the top input roll lifted off.
Figure 3:
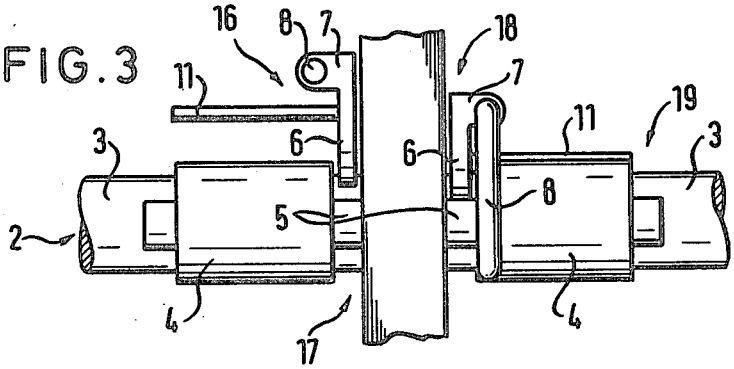
FIGS. 3 to 6 are front views illustrating various different possibilities of the arrangement of the swivel levels relative to twin input top rolls in various embodiments of machines of the invention.

If, with the illustrated arrangement, thread breakage occurs, then, as shown in FIG. 1, the actuating part 8 can be swung in the direction of the arrow I about the axis provided by the pivot 12, so that the circular segment 13 engages under the axle journal, or the axle 5, of the top input roll 4 and lifts this from the bottom input roll 3 (FIG. 2).

At the same time the clamping pin 11 presses the roving 9 against roll surface 10 in the lever exit region of the top input roll 4. The roving 9 is thereby clamped fast and its leading end rests on the guide table 15. In this way there is obtained, in a simple manner, reliable separation of the input top roll 4 from the input bottom roll 3, as well as clamping of the roving 9 against the roll surface 10 of the top input roll 4.

If, as shown in FIG. 2, the actuating part 8 is moved in the direction of the arrow II, then the axle journal 5 of the top input roll 4 passes out of the effective range of the circular segment 13 or of the lifting element and is thus moved back onto the input bottom roll 3. Since the clamping of the roving 9 against the roll surface 10 of the top input roll 4 is cancelled and the clamping pin 11 is no longer effective, the roving 9 can again be progressed by the pair of input rolls, whereby the condition illustrated in FIG. 1 can be resumed.

Figure 7:
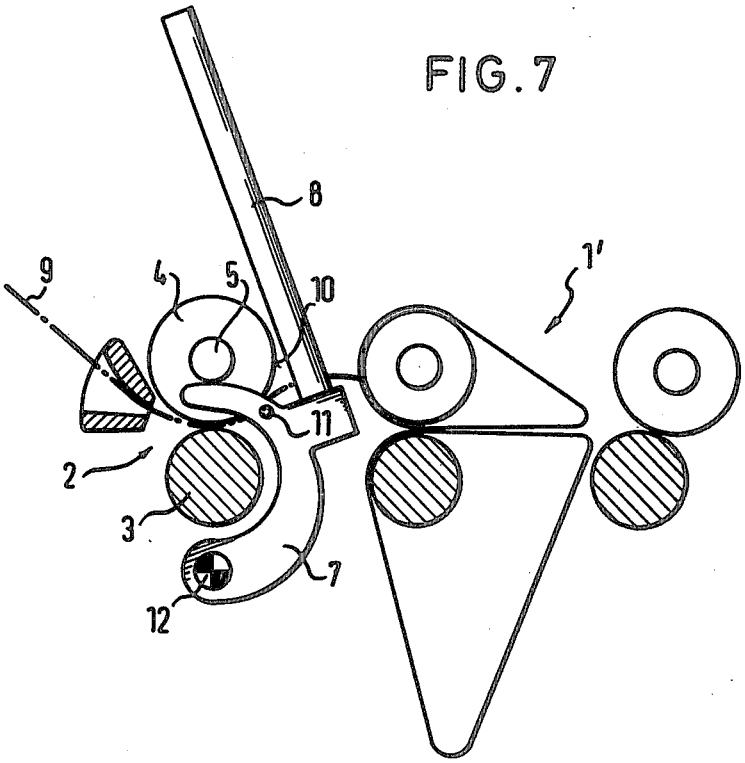
FIG. 7 is a view comparable with FIGS. 1 and 2, but illustrating another version.

If fibrous material of short staple length is being processed, as shown in FIG. 7 the guide table 15 can be dispensed with.

When the swivel lever 7 is in the position shown in FIG. 7, the roving 9 is forced against the roll surface 10 of the top input roll 4 when this is lifted from the bottom input roll 3 and thus hangs freely downwards, without it being able to arrive in the conveying passage of the drawing frame part 1'.

The clamping pin 11 preferably lies at the exit side of the input roll pair 2 and co-operates with the roll surface 10 of the top input roll 4 in a plane which lies below a horizontal plane containing the axis 5 of the top input roll 4.

Shown in plan in FIGS. 3 to 6 are various possibilities for the arrangement of the swivel lever 7 where the spinning machine has twin input top rolls. In the embodiment in FIG. 3, two swivel levers 7 are arranged between the individual top rolls 4 at entry side 16, namely in the inside region 18. In this figure, the left-hand swivel lever 7 does not engage, by its cam track 6, with the axle journal 5, whereas the right-hand swivel lever 7 is engaging, by its cam track 6, below the respective axle journal 5 of the top input roll 4. In this way lifting-off of the right hand top input roll 4 is achieved with the clamping pin 11 forcing the roving (not shown in more detail) against the roll surface of the top input roll 4.

Figure 4:
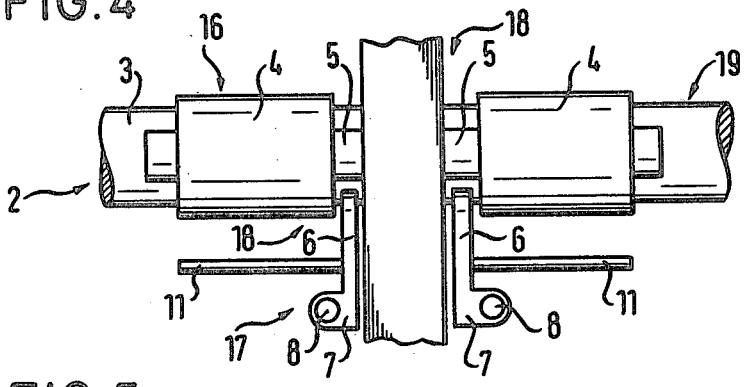
Figure 5:
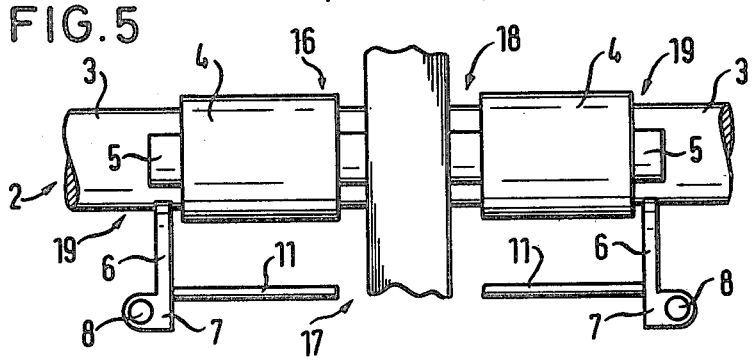

In the embodiment of FIG. 4, the two swivel levers 7 are arranged in inner region 19 and at the exit side 17 of the input roll pair 2. Both swivel levers are not in the working position, i.e. the two curved tracks 6 do not engage under the respective axles or axle journals 5 of the top input rolls 4. In the exemplified embodiment, as shown in FIG. 5, the two swivel levers 7 are arranged in the eccentric region 19, at the exit side 17. Here, too, the two swivel levers 7 with their clamping pins 11 and curved tracks 6 are not illustrated in the working position.

Figure 6:
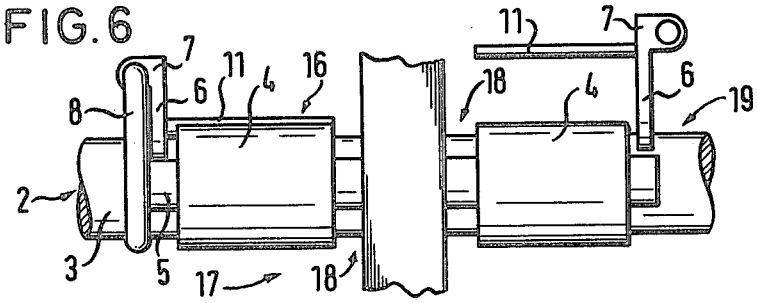

In the embodiment illustrated in FIG. 6, the two swivel levers 7 are arranged to the outside of the twin upper rolls 4 and at the entry side 16 of the input roll pair 2. The curved track or cam edge 6 of the left-hand swivel lever 7 engages below the left-hand top input roll 4 and lifts this off, and the clamping pin 11 forces the roving (not shown in more detail) against the roll surface of the input top roll 4.

Figure 8:
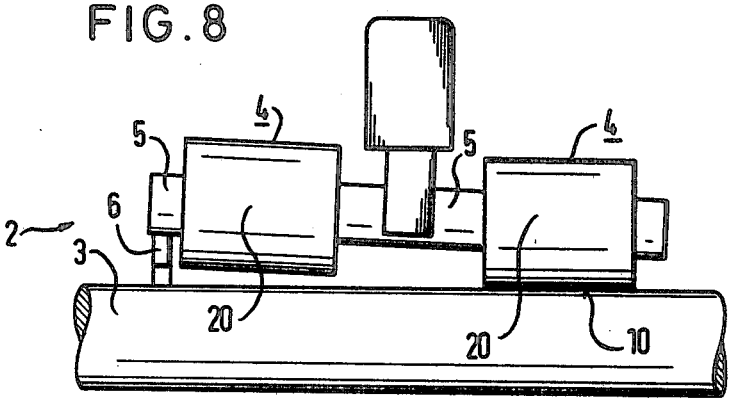
FIG. 8 is a front view illustrating an embodiment comprising an input roll pair having twin top input rolls arranged in swinging suspension.

In the embodiment of FIG. 8, which shows an input roll pair 2 having twin top input rolls 4 in front elevation, the twin top input rolls 4 have an oscillating mounting 20. If, for example the curved track 6 of a swivel lever 7 engages under the axle journal 5 of the left-hand top input roll 4, the latter is lifted off; despite this lifting-off movement, however, the right-hand top input roll rests satisfactorily (or precisely) on the bottom input roll. In this way, despite lifting off of one top input roll, the other top input roll does not experience any impairment in its effect.

Figure 11:
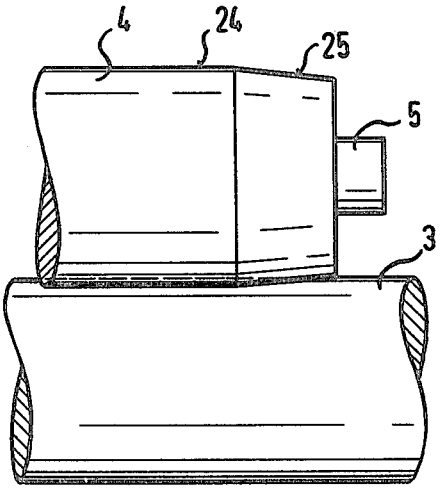
FIG. 11 is an enlarged front view illustrating an input roll pair partially broken away, in another embodiment.

As in the arrangement of FIG. 11, it is also possible, in a machine having a twin input top roll 4, to design the machine in such a way that the elastic roll covering 24 of each individual top roll has, on the side opposite the other individual top roll, a conical bevelling 25 for about one quarter to one eighth of the width of the roll covering 24. This conical bevel 25 is such that support of the roll covering, on the bottom roll 3, without elastic deformation in the cylindrical region is achieved. Also in this way it is possible, in the case of a twin top input roll, to lift the respective individual top roll 4 off on one side only, by way of the swivel lever 7, whilst the other input top roll remains in the working position.

Figure 9:
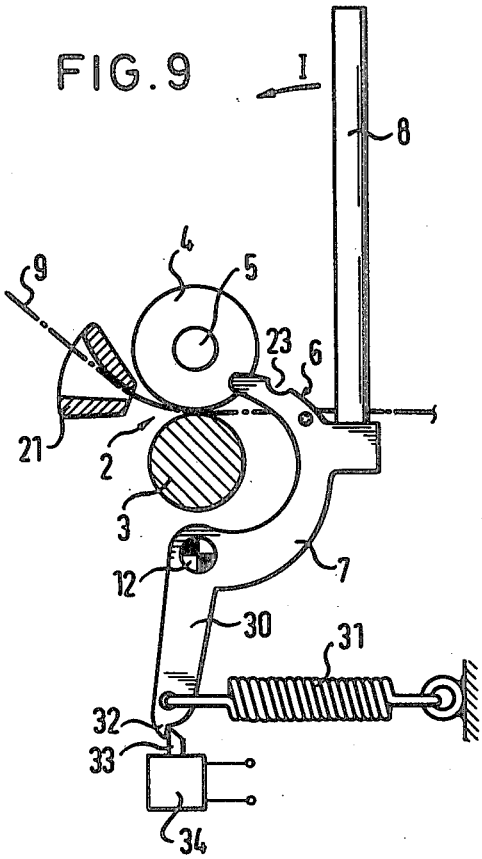
FIGS. 9 and 10 are views comparable with FIGS. 1, 2 and 7 but illustrating two alternative arrangements for actuating the swivel lever.

The actuating part 8 of the swivel lever 7 may be movable by hand and/or by a sensing or monitoring apparatus. As shown in FIG. 9 the possibility also exists of the swivel lever 7 having an additional lever arm 30 on which acts a tension spring 31 connected securely to the housing. Furthermore, the lever arm 30 has a nose 32 which co-operates with a lock pawl 33 of a control apparatus 34. This control apparatus 34 reacts to a thread breakage signal, whereby the lock pawl 33 is drawn back and frees the nose, so that, under the action of the spring 31 and of the lever arm 30, the swivel lever 7 swings about the pivot 12 in the anti-clockwise direction and thus the curved track 6 comes into the region of the axle 5 of the input top roll. In this embodiment, moreover, the curved track 6 has a sunken catch, or recess, 23 in which the axle journal 5 of the input top roll 4 reposes in the lifted-off position.

Figure 10:
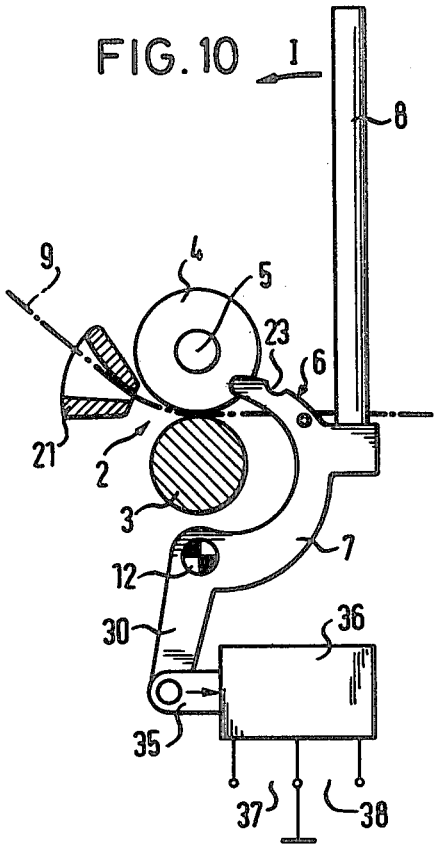

In the case of the embodiment in accordance with FIG. 10, the swivel lever 7 again has an additional lever arm 30 which co-operates, by way of an armature (or anchor) 35, with a control apparatus 36. This control apparatus 36 may react in the region 37 to a switch-on signal of a thread attachment apparatus and in the region 38 to a thread breakage signal of a thread monitor. In one case (region 38) the control apparatus 36 brings about a movement of the armature 35 in the direction of the arrow, whereby the swivel lever 7 is rotated by way of the lever arm 30 in the anti-clockwise direction and thus lifting-off of the top input roll 4 is effected. In the lifted-off state of the top input roll the axle 5 or journal engages into a sunken catch or detent 23.

In another example a contact 37 brings about opposite movement, i.e. the return into the initial position shown in FIG. 10.

It will be understood from the foregoing that the swivel lever 7, with the lifting element which may for example be designed as a curved track or as a lifting wedge, and with the clamping pin 11, provides for simple and reliable separation of the input top roll from the bottom input roll and clamping of the roving with rapid automatic re-insertion into the conveying nip of the following roller train pair is made possible.

We claim:

1. In a spinning machine, a drafting frame comprising an input roll pair including:

a bottom roll, a top roll mounted above and cooperating with said bottom roll, a spindle forming part of said top roll, mounting means permitting said top roll to be lifted from said bottom roll in the event of yarn breakage; and engagement means adapted for lifting said top roll upon yarn breakage and including a lift element mounted for movement into lifting engagement with said spindle, and means defining a clamping element carried by said lift element and movable by said movement of said lift element into lifting engagement with said spindle for engaging roving passing between said input roll pair and clamping the leading end of said roving against said top roll.

2. The combination defined in claim 1, wherein said lift element has a rest position spaced from said spindle and a lifting position in which it engages and lifts said spindle away from said bottom roll, said lift element having a cam edge normally disengaged from said spindle but slidably engageable with said spindle in moving of said lift element from rest position to lifting position.

3. The combination defined in claim 2, further including a lever swingable about an axis located below said top roll, said lifting element comprising a circular segmental extension carried at the free end of said lever, said cam edge being provided on said segmental extension for swinging with said lever into and out of engagement with said spindle.

4. The combination defined in claim 3 wherein said clamping element comprises a clamping pin carried by said lever and adapted to engage with said top roll at the delivery side thereof at a level below a horizontal plane through the axis of rotation of said top roll.

5. The combination defined in claim 2, in which in said lifting position said cam edge extends transversely beneath said spindle of said top roll and said clamping element extends from said lift element axially along the periphery of said top roll to one side of and somewhat below said spindle so as to support the lifted top roll on said cam edge and clamping element.

6. The combination defined in claim 1, wherein said lift element is in the form of a lifting wedge advanceable between the axes of said top and bottom rolls while engaging said spindle of said top roll for wedging said top roll away from said bottom roll.

7. The combination defined in claim 1 further including a second roll pair disposed to receive roving from said input roll pair, and a guide table disposed between said input roll pair and said second roll pair.

8. In a spinning machine, a drafting frame comprising input roll means including:

a bottom roll, twin top rolls mounted above and cooperating with said bottom roll, spindle means forming parts of said top rolls, mounting means permitting said top rolls to be lifted from said bottom roll in the event of yarn breakage; and engagement means adapted for lifting said top roll upon yarn breakage and including a lift element means mounted for movement into lifting engagement with said spindle means of said top rolls, and clamping means carried by said lift element and movable by said movement of said lift element into lifting engagement with said spindle means for engaging roving passing between said top and bottom rolls of said input roll means and clamping the leading end of said roving.

9. The combination defined in claim 8 in which said lift element means is engagable with said spindle means between said top rolls.

10. The combination defined in claim 9 in which said lift element is engagable with said spindle means from the entry side of said input roll means.

11. The combination defined in claim 9 wherein said lift element is engagable with said spindle means from the exit side of said input roll means.

12. The combination defined in claim 8 wherein said lift element means is engagable with said spindle means in location such that said top rolls are between members of said lift element means.

13. The combination defined in claim 1 further including an actuating member connected to said lift element for moving the latter into lifting engagement with said spindle.

14. The combination defined in claim 13 wherein said actuating member is manually displaceable.

15. The combination defined in claim 13 wherein said actuating member is displaceable by means of monitoring apparatus.

16. The combination defined in claim 15 wherein said monitoring apparatus serves to initiate a signal which in turn initiates displacement of said actuating member, upon thread breakage.

17. The combination defined in claim 1 further including a force store which is triggered to move said lift element into lifting engagement with said spindle upon thread breakage.

18. The combination defined in claim 8 wherein said twin top rolls are mounted to enable their axis to be displaced relative to the axis of the bottom roll.

19. The combination defined in claim 1, wherein said lift element has an edge so angled to the direction of movement of said lift element as to bring successive portions of said edge progressively into proximity and then into lifting engagement with said spindle, said edge terminating in a recess means into which said spindle drops upon completion by said lift element of its moving into lifting engagement with said spindle.

20. The combination defined in claim 8 wherein each top roll of said twin top rolls has an elastic covering and in that, in each roll, the end of said covering remote from the other of said top rolls is tapered.

* * * * *